US008326571B2

(12) United States Patent
Nagase

(10) Patent No.: US 8,326,571 B2
(45) Date of Patent: Dec. 4, 2012

(54) PERSON LOCATION DETECTION APPARATUS AND AIR CONDITIONER

(75) Inventor: Keiji Nagase, Nara (JP)

(73) Assignee: Sharp Kabushiki Kaisha, Osaka-Shi, Osaka (JP)

( * ) Notice: Subject to any disclaimer, the term of this patent is extended or adjusted under 35 U.S.C. 154(b) by 373 days.

(21) Appl. No.: 12/320,311

(22) Filed: Jan. 23, 2009

(65) Prior Publication Data

US 2009/0210193 A1 Aug. 20, 2009

(30) Foreign Application Priority Data

Jan. 28, 2008 (JP) ..... 2008-016547

(51) Int. Cl.

| | |
|---|---|
| ***G01B 11/00*** | (2006.01) |
| ***G01B 7/00*** | (2006.01) |
| ***G01B 15/00*** | (2006.01) |
| ***G01J 1/42*** | (2006.01) |
| ***G05B 13/00*** | (2006.01) |

(52) U.S. Cl. ..... 702/159; 702/152; 702/94; 702/150; 702/155; 250/208.2; 250/338.1; 700/276

(58) Field of Classification Search ..... 702/159, 702/152

See application file for complete search history.

(56) References Cited

U.S. PATENT DOCUMENTS

| | | | | |
|---|---|---|---|---|
| 6,324,453 | B1 * | 11/2001 | Breed et al. | 701/45 |
| 7,436,496 | B2 * | 10/2008 | Kawahito | 356/5.01 |
| 2005/0232466 | A1 * | 10/2005 | Kampchen et al. | 382/103 |
| 2007/0097349 | A1 * | 5/2007 | Wada et al. | 356/4.06 |
| 2007/0263907 | A1 * | 11/2007 | McMakin et al. | 382/115 |

FOREIGN PATENT DOCUMENTS

| | | |
|---|---|---|
| JP | 05-187682 | 7/1993 |
| JP | 2006-220405 | 8/2006 |

* cited by examiner

*Primary Examiner* — Timothy Thompson
*Assistant Examiner* — Rhadames J Alonzo Miller
(74) *Attorney, Agent, or Firm* — Edwards Wildman Palmer LLP; David G. Conlin; George N. Chaclas

(57) ABSTRACT

A person location detecting apparatus according to the present invention includes a light emitting section for radiating a projection light and a TOF method distance image sensor for receiving a reflected light from a room space of the projection light to output distance information in accordance with a distance to an object in the room space from each of a plurality of light receiving sections, and further includes a distance change detecting section for detecting a distance change to the object in the room space based on the distance information from the TOF method distance image sensor and a person distinguishing section for distinguishing a person by specifying a shape of a detected distance change area to detect a direction and distance to the distance change area that is specified as a shape of a person as a location of a person.

13 Claims, 10 Drawing Sheets

FIG.8

| kind of shape characteristic | | | shape indicator | | | | | | | | | | | | | | | | | | | | | | | |
|---|---|---|---|---|---|---|---|---|---|---|---|---|---|---|---|---|---|---|---|---|---|---|---|---|---|---|
| | | | head width (Wh) | | | | head length (Lh) | | | | body width (Wb) | | | | body length (Lb) | | | | ratio (Wh/Wb) | | | | ratio (Lh/Lb) | | | |
| | | | minimum | average | maximum | deviation | minimum | average | maximum | deviation | minimum | average | maximum | deviation | minimum | average | maximum | deviation | minimum | average | maximum | deviation | minimum | average | maximum | deviation |
| male adult | still state | standing | | | | | | | | | | | | | | | | | | | | | | | | |
| | | sitting | | | | | | | | | | | | | | | | | | | | | | | | |
| | | lying | | | | | | | | | | | | | | | | | | | | | | | | |
| | moving state | standing | | | | | | | | | | | | | | | | | | | | | | | | |
| | | sitting | | | | | | | | | | | | | | | | | | | | | | | | |
| | | lying | | | | | | | | | | | | | | | | | | | | | | | | |
| male child | still state | standing | | | | | | | | | | | | | | | | | | | | | | | | |
| | | sitting | | | | | | | | | | | | | | | | | | | | | | | | |
| | | lying | | | | | | | | | | | | | | | | | | | | | | | | |
| | moving state | standing | | | | | | | | | | | | | | | | | | | | | | | | |
| | | sitting | | | | | | | | | | | | | | | | | | | | | | | | |
| | | lying | | | | | | | | | | | | | | | | | | | | | | | | |

PERSON LOCATION DETECTION APPARATUS AND AIR CONDITIONER

This nonprovisional application claims priority under 35 U.S.C. §119(a) to Patent Application No. 2008-016547 filed in Japan on Jan. 28, 2008, the entire contents of which are hereby incorporated by reference.

BACKGROUND OF THE INVENTION

1. Field of the Invention

The present invention relates to a person location detecting apparatus for detecting a location of a person and an air conditioner using the person location detecting apparatus for detecting a location of a person to perform various kinds of controls to make a person comfortable, such as air conditioning flow control for preventing air flow to directly hit a person.

2. Description of the Related Art

Reference 1 discloses a human body detecting sensor of an air conditioner as a conventional person location detecting apparatus of this kind, which is illustrated in FIG. 12.

FIG. 12 is a block diagram illustrating an exemplary essential configuration of a conventional air conditioner disclosed in Reference 1.

In FIG. 12, a control apparatus 100 of the conventional air conditioner includes: a location detecting section 101 for detecting an existing direction and a distance of a human body from the air conditioner; a main control section 102 for performing a main control of the air conditioner; a temperature setting changing section 103 for changing a temperature setting; a wind direction changing section 104 for changing a ventilation direction; a wind direction control wing 105 for changing the ventilation direction from side to side and up and down; a wind direction control wing driving section 106 for driving the wind direction control wing 105; a wind velocity changing section 107 for changing a ventilation velocity; a ventilator 108 for ventilating; and a ventilator driving section 109 for driving the ventilator 108.

The location detecting section 101 is configured with two infrared ray sensors for detecting infrared rays radiated from a human body; a Fresnel lens for focusing infrared rays on the infrared ray sensors; and an amplifier substrate that implements an amplifier for amplifying an output of the infrared ray sensors.

Thus, based on an output from the location detecting section 101 for detecting an existing direction and a distance of a human body from the air conditioner, the main control section 102 changes a temperature setting using the temperature setting changing section 103; changes a ventilation direction using the wind direction changing section 104; and changes a ventilation velocity using the wind velocity changing section 107. As a result, a spot operation is automatically performed in accordance with a movement of a person, so that a comfortable and convenient air conditioning can be achieved.

On the other hand, Reference 2 discloses, as a conventional person location detecting apparatus, an air conditioning apparatus for detecting a human body from image information from an image sensor to use the detection result for air conditioning.

In Reference 2, a location of a person in a room, a distance, the number of the people, and the like are detected using image information, and further, an up-and-down flap for controlling a wind direction in an up-and-down direction and a left-and-right flap for controlling a wind direction in a left-and-right direction of the indoor portion are configured to distribute an air flow with a flap mechanism to control the air flow freely regardless of the location of a person. As a result, a constantly comfortable and economical air conditioning operation can be performed not only in an air conditioning space in an ordinary house but also in a large living room and a room combining living and dining rooms, found often in a modern house, and a room having a high ceiling. Because of this, an air flow can be freely controlled with an air conditioning apparatus that recognizes a location of a person, and comfortable air conditioning can be performed for each individual in accordance with the location of a person and the number of the people.

The detecting of a person by the image sensor is performed to detect a movement in a space of each of the areas that are divided from an image, and the amount of the movement is calculated. The dividing does not necessarily have to be an exact dividing, but can be particular points that are center points of the plurality of divided areas. The amount of the movement is taken in for several times to use the information for the wind direction control. In order not to detect a rapid change, such as turning on and off of a light, and an amount of a complicated movement of stopping and moving by a plurality of people, the detection of the amount of the movement by successively recording and calculating images is performed about five times, and an average point excluding the maximum and minimum values, is taken. As a result, an air conditioning apparatus, including a flap, will not respond and move when a person stays in one location of a room and another person passes in front. That is, when an average of the amount of the movement in a certain location is below a predetermined, constant threshold value, the accumulated amount of the movement is decreased. On the contrary, when the average is above the threshold value, the amount is increased. As a result, the weight increases at that location, which indicates that there is a high possibility of someone's existence there. It is determined that someone is active at a certain location when he is moving for a long time, whereas no response is provided for someone passing through the location or staying there only for a short while so that an unnecessary movement can be prevented for the air conditioning apparatus. Thus, for a person who is in the room, no noisy movement of the flap will be made and a preferable air conditioning is continued, so that no mental stress will be created and no unnecessary wind flow or wind change is felt by the person, enabling the person to continue a relaxed state giving himself to a surrounding environment.

Reference 1: JP Patent No. 2921256 (Japanese Laid-Open Publication No. 5-187682)

Reference 2: Japanese Laid-Open Publication No. 2006-220405

SUMMARY OF THE INVENTION

According to the conventional configuration of Reference 1 described above, an existing direction of a human body is estimated from a formation pattern of output strength values from the two infrared ray sensors, and a distance to the human body is estimated based on an absolute value of the output strength values. Therefore, a high temperature of heat distribution can be detected in the direction of the human body detected by the air conditioner whereas the distance to the human body detected by the air conditioner is merely an estimation, which is low in accuracy. That is, in a case of an infrared ray sensor, the movement of heat radiated from a human body is detected. However, other heat from various sources can also be detected, including heat from a floor and a wall, a heat movement due to a solar radiation, and heat from a heating device, an electric appliance and a kitchen. Therefore, the infrared ray sensor is suitable only for a control of a rough resolution, such as a location of a person being far, near, on a right or left side. Because of this, an air flow may directly hit a person, or an accuracy of an air flow control may be decreased for an air conditioner. Further, because an infrared ray sensor is used, no person may be detected when a temperature change of a measurement object cannot be measured in a room because, for example, a person in the room has been there for a long time and his body temperature has dropped. Further, only a rough control of a wind direction is possible, such as far, near, left and right, when the air flow of the air conditioner is controlled. Only a conventional and ordinary mechanism is used for the flap for controlling the air flow. As a result, the air flow may not reach some location of a person and a comfortable space may not be provided. Particularly, a controllable range is limited in a large living room or a room combining living and dining rooms, which is found often in a modern house, or in a room having a high ceiling, resulting in an insufficient control of the entire space for a comfortable environment. In such a case, the degree of comfort varies depending on the location and the temperature setting may be required to be adjusted depending on the location, resulting in a comfort problem and an economical issue. This kind of problem is due to, not only the performance of the air conditioner itself, but also the low accuracy of the measuring of the distance from the air conditioner to the person.

Next, according to the conventional configuration of Reference 2 described above, the direction and distance of a human body are detected in a room using image information, and therefore, the accuracy of detecting the direction of the human body is expected to be improved. However, the movement of a person is detected from the image information from an image sensor, and it is estimated in which direction of the divided areas the person is located, how far it is to the center of the area, and the like. If the areas are a result of a rough division, the improvement cannot be expected as a matter of course in the accuracy of detecting the distance of the human body from the air conditioner. In addition, for example, when the direction and distance of a person are detected from the image information and a plurality of arbitrary points are all processed by triangulation using a stereo camera, the amount of calculation by image processing will be enormous. An extremely high cost cannot be avoided in order to achieve such a method, and therefore, it is not realistic to calculate and perform arithmetic processing on all of the arbitrary points in a surface by the triangulation.

The present invention is intended to solve the conventional problems described above. The objective of the present invention is to provide a person location detecting apparatus and an air conditioner, and more particularly, a personal location detecting apparatus that can achieve a high accuracy for detecting a location (direction and distance) of a person in a room without making an enormous amount of calculations when arithmetic processing is performed on all of the plurality of points in a two dimensional way, and an air conditioner that can achieve an improvement on conservation of energy and comfort by an improvement on the accuracy of the air flow control by using the person location detecting apparatus.

A person location detecting apparatus according to the present invention includes a light emitting section for radiating a projection light and a TOF (Time Of Flight) method distance image sensor for receiving a reflected light from a room space of the projection light to output distance information in accordance with a distance to an object in the room space from each of a plurality of light receiving sections, the person location detecting apparatus further comprising a distance change detecting section for detecting a distance change to the object in the room space based on the distance information from the TOF method distance image sensor and a person distinguishing section for distinguishing a person by identifying a shape of a detected distance change area to detect a direction and distance to the distance change area that is identified as a shape of a person as a location of a person, thereby achieving the objective described above.

Preferably, in the person location detecting apparatus according to the present invention, the distance change detecting section measures a distance to the object in the room space in real time, calculates a time change amount of each distance in the room space based on each measured distance in the room space, and detects an existence and non-existence of a distance change based on whether or not the time change amount is less than a predetermined threshold.

Still preferably, in a person location detecting apparatus according to the present invention, the distance change detecting section includes a distance balanced state determining section for measuring a time change amount of a distance to the object in the room space in real time, and determining that the distance in the room is in a balanced state by the measured time change amount of the distance becoming asymptotic to zero.

Still preferably, in a person location detecting apparatus according to the present invention, the determining that the distance is in a balanced state corresponds to a case where there is no change in the location of the object.

Still preferably, in a person location detecting apparatus according to the present invention, the distance change detecting section includes a distance change state determining section for calculating a distance difference value of a frame distance value of the room space in a distance balanced state and each frame distance value from the TOF method distance image sensor to determine that the distance in the room is in a changing state when the distance difference value is greater than or equal to a predetermined threshold value and continues for a set time or more.

Still preferably, in a person location detecting apparatus according to the present invention, the distance difference value sets a distance frame difference threshold value for each measurement distance range in accordance with a distance resolution of the TOF method distance image sensor, and maintains the distance frame difference threshold value in a predetermined recording section in a table in order to improve an accuracy for determining a distance change.

Still preferably, in a person location detecting apparatus according to the present invention, the person distinguishing section distinguishes a person by comparing a value indicating a characteristic of a registered shape of a person with regard to a moving state and a still state of a person, such as a standing state, a sitting state, a lying state, and a figure difference and a value indicating a characteristic of a shape of the detected distance change area.

Still preferably, in a person location detecting apparatus according to the present invention, the value indicating the characteristic of the registered shape of the person is normalized by dividing a human body into each part of a trunk, a leg, and an arm and calculating a ratio of a short side length and a long side length in each part of the human body.

Still preferably, in a person location detecting apparatus according to the present invention, the value indicating the characteristic of the registered shape of the person is determined by calculating at least a maximum value and a minimum value and determining an indicated value range of a shape characteristic pattern from the maximum value and the minimum value.

Still preferably, in a person location detecting apparatus according to the present invention, the value indicating the characteristic of the registered shape of the person is determined by calculating at least a maximum value, a minimum value and an average value as well as calculating a standard deviation value using the average value, determining an indicated value range of a shape characteristic pattern from the maximum value and the minimum value, and determining a degree of variation of a shape characteristic pattern from the standard deviation value.

Still preferably, in a person location detecting apparatus according to the present invention, the light emitting section radiates a near infrared pulse light at a constant cycle as the projection light to the room space.

Still preferably, in a person location detecting apparatus according to the present invention, the light receiving section includes a photoelectric conversion section in a middle, and two pixel output electrodes V1 and V2 at points with point symmetry with respect to a center of the photoelectric conversion section interposed therebetween with two electric charge transfer gates for inputting gate signals that are contrary to each other, and outputs from the two pixel output electrodes V1 and V2 signal charges divided depending on a flight time of light corresponding to a distance to the object as the distance information.

Still preferably, in a person location detecting apparatus according to the present invention, the signal charges from the two pixel output electrodes V1 and V2 are converted into output voltage information in accordance with the distance and outputted from the TOF method distance image sensor as the distance information.

Still preferably, in a person location detecting apparatus according to the present invention, the distance L to the distance change area, the shape of which is identified as the person, is estimated by detecting the flight time T of the light to the person, and by letting c be a known speed of the light from $L=(1/2)\cdot c\cdot T$.

An air conditioner according to the present invention detects a location (direction and distance) of a person using the person location detecting apparatus according to the present invention, and performs an air conditioning in accordance with the detected location of the person, thereby achieving the objective described above.

The functions of the present invention having the structures described above will be described hereinafter.

According to the present invention, included are a distance change detecting section for detecting the change of distance to an object in a space of a room based on distance information from a TOF method distance image sensor; and a person distinguishing section for distinguishing whether or not the object is a person by identifying a shape of the object in the detected distance change area; and a direction and distance to the distance change area, where the shape of a person is identified, is detected as a location of a person. Because of this, the amount of calculations will not be enormous as in the conventional triangulation even when arithmetic processing is performed on all of the plurality of points in a two dimensional way, and a location (direction and distance) of a person can be detected with high accuracy in a room. Therefore, the temperature, humidity and air flow can be accurately controlled in accordance with the location of a person, thereby improving the conservation of energy and the comfort.

According to the present invention as described above, included are a distance change detecting section for detecting the change of distance to an object in a space of a room based on distance information (information regarding output voltage in accordance with the distance) from a TOF method distance image sensor; and a person distinguishing section for distinguishing whether or not the object is a person by identifying a shape of the object in the detected distance change area; and a direction and distance to the distance change area, where the shape of a person is identified, is detected as a location of a person. Because of this, the amount of calculation will not be enormous as in the conventional triangulation even when arithmetic processing is performed on all of the plurality of points in a two-dimensional way, and a location (direction and distance) of a person can be detected with high accuracy in a room. Therefore, the temperature, humidity and air flow can be accurately controlled in accordance with the location of a person, thereby improving the conservation of energy and the comfort.

These and other advantages of the present invention will become apparent to those skilled in the art upon reading and understanding the following detailed description with reference to the accompanying figures.

BRIEF DESCRIPTION OF THE DRAWINGS

FIG. 8 is a diagram illustrating kinds and shape indicators of characteristics of shapes used in a person distinguishing section in FIG. 1 in a table.

FIG. 11(*b*) is a diagram illustrating a distance balanced state frame. FIG. 11(*c*) is a diagram illustrating a measurement distance frame. FIG. 11(*d*) is a diagram illustrating a detected distance change frame.

Figure 1:
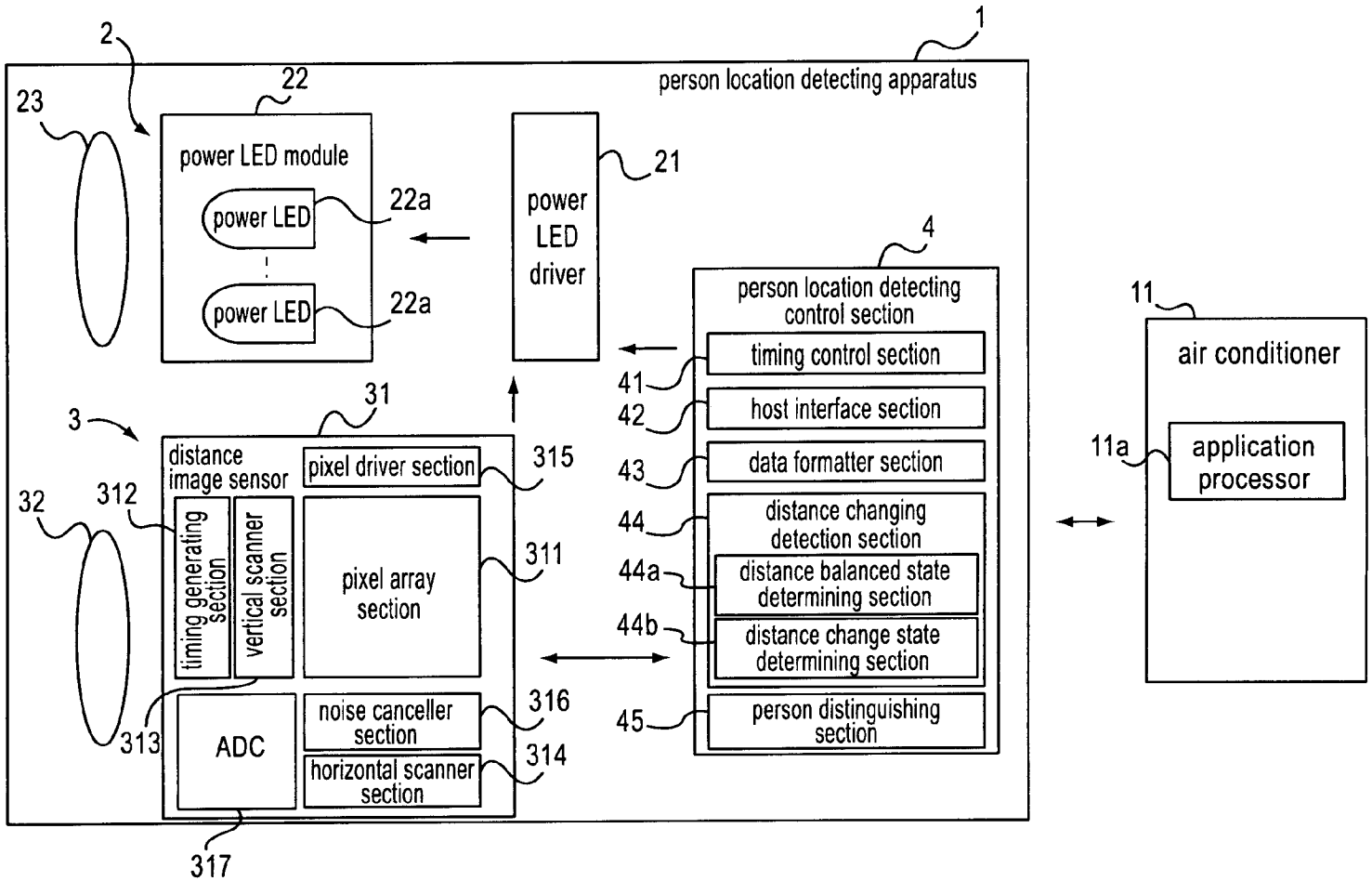
FIG. 1 is a block diagram illustrating an exemplary essential configuration of a person location detecting apparatus according to the embodiment of the present invention.

1 person location detecting apparatus
11 air conditioner
11*a* application processor
2 light emitting section
21 power LED driver

22 power LED module
22*a* power LED
23 radiation angle adjusting lens
3 light receiving section
31 TOF method distance image sensor
311 pixel array section
312 timing generating section
313 vertical scanner section
314 horizontal scanner section
315 pixel driver section
316 noise canceller section
317 A/D controller
32 viewing angle adjusting lens
4 person location detecting control section
41 timing control section
42 host interface section
43 data formatter section
44 distance changing detection section
44*a* distance balanced state determining section
44*b* distance change state determining section
45 person distinguishing section
A target object
T flight time of light
c speed of light
C1 capacity in pixel output electrode V1
C2 capacity in pixel output electrode V2
PG electric charge conversion area
TX1, TX2 electric charge gate
V1, V2 pixel output electrode
ΔV1, ΔV2 output voltage at pixel output electrode
T0 pulse width
Td delay time of reflected light
Iph light current by reflected light

DESCRIPTION OF THE PREFERRED EMBODIMENTS

Hereinafter, an embodiment of a person location detecting apparatus according to the present invention will be described with reference to accompanying figures, where the person location detecting apparatus is used for the control of the air conditioning by an air conditioner that conditions and controls the temperature, humidity, and air flow in a room in accordance with the location of a person.

FIG. 1 is a block diagram illustrating an exemplary essential configuration of a person location detecting apparatus according to the embodiment of the present invention.

Figure 2:
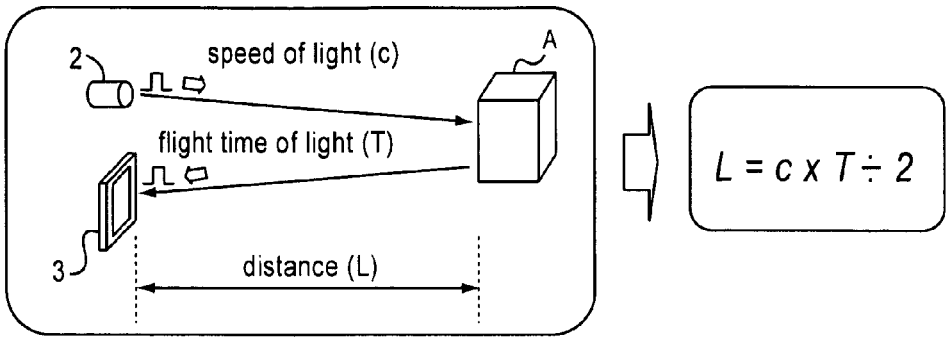
FIG. 2 is a diagram schematically illustrating a principle of measuring a distance with a TOF method that is used by the person location detecting apparatus in FIG. 1.

In FIG. 1, a person location detecting apparatus 1 according to the embodiment includes: a light emitting section 2 as a light source for radiating a projection light to a target object A for distance measurement; a light receiving section 3 for receiving a reflected light from the target object A of the distance measurement using the projection light; and a person location detecting control section 4 for detecting a location of a person as the target object A based on received-light information from the light receiving section 3, as illustrated also in FIG. 2. Using the TOF (Time Of Flight) technique to detect a flight time T of the light to the target object A based on the received-light information from the light receiving section 3 and to determine a distance L to a reflecting object (target object A) by counting backwards from the known light speed c, and using location information of a plurality of points for each pixel, the location (direction and distance) of a person is detected in three dimensions with high accuracy.

The light emitting section 2 includes: a power LED driver 21, in which a timing for emitting a projection light is controlled by the person location detecting control section 4; a power LED module 22 for emitting a projection light from a plurality of power LEDs 22*a* that is driven by the power LED driver 21; and a radiation angle adjusting lens 23 positioned at the front of the power LED module 22 provided with the plurality of power LEDs 22*a* for adjusting a radiation angle of the projection light to the target object A.

The light receiving section 3 includes: a TOF method distance image sensor 31 for receiving a reflected light from the target object A to detect an image capturing signal in accordance with the distance L to the target object A for a plurality of pixels; and a viewing angle adjusting lens 32 positioned in the front of the TOF method distance image sensor 31, for adjusting a viewing angle of the reflected light from the target object A.

The TOF method distance image sensor 31 includes: a pixel array section 311, which is a plurality of light receiving sections; a timing generating section 312 for generating a timing signal for reading a signal from each pixel (light receiving section); a vertical scanner section 313 for scanning each pixel (light receiving section) in a vertical direction; a horizontal scanner section 314 for scanning each pixel (light receiving section) in a horizontal direction; a pixel driver section 315 for controlling the vertical scanner section 313 and the horizontal scanner section 314 using the timing signal to drive the reading of a signal from each pixel (light receiving section); a noise canceller section 316 for performing a noise cancel process on an image signal read out by the pixel driver section 315 from the pixel array section 311; and an A/D controller 317 for performing a A/D conversion on an output signal from the noise canceller section 315 to be outputted.

The pixel array section 311 includes a plurality of light receiving sections (about eighty thousand pixels, for example) arranged in a matrix of row and column directions and in two dimensions for receiving a reflected light from a target object A, and performing a photoelectric conversion on the reflected light to generate a signal charge. Herein, a light receiving section of a one pixel unit having a characteristic configuration of the present invention, is illustrated in a plan configuration view of FIG. 3.

Figure 3:
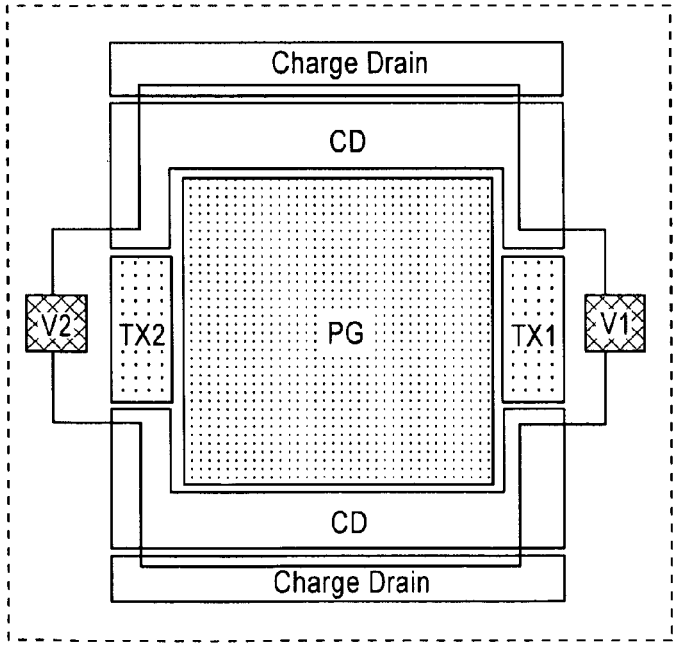
FIG. 3 is a plan configuration view of a light receiving section of a one pixel unit in a pixel array section in FIG. 1.

As illustrated in FIG. 3, the light receiving section of the one pixel unit is provided with a light receiving section for receiving a reflection light from the target object A at the middle portion as a photoelectric conversion area (electric charge conversion area PG). Pixel output electrodes V1 and V2 are provided via electric charge transfer gates TX1 and TX2 on the left and right of the electric charge conversion area PG. Each signal charge read by the respective output electrode V1 and V2 is timely distributed using reciprocal signals to the electric charge transfer gates TX1 and TX2.

More specifically, signal charges, which are distributed depending on a flight time (delay time) of light corresponding to the distance L to an object, are outputted from two of the pixel output electrodes V1 and V2, and the signal charges are converted into output voltage information in accordance with the distance. The output voltage information is subsequently outputted from the TOF method distance image sensor 31 as distance information.

CDs are background light signal discharging gates provided on top and bottom positions of the electric charge conversion area PG in FIG. 3.

Herein, a principle of determining the distance L to the target object A in three dimensions with a plurality of points will be briefly described with the TOF (Time OF Flight) technique illustrated in FIG. 2.

First, electric charge Q is determined as a time integral of a time ΔT, where a flowing current is denoted as I, and it is given by the formula $Q=I\cdot\Delta T$. In addition, the electric charge Q, which is accumulated by applying the voltage ΔV to the electrode, is given by Q=C·ΔV, where C is a capacity of a dielectric. With the two expressions, Output terminal voltage V is given by the formula ΔV=(1/C)·I·ΔT.

Figure 4:
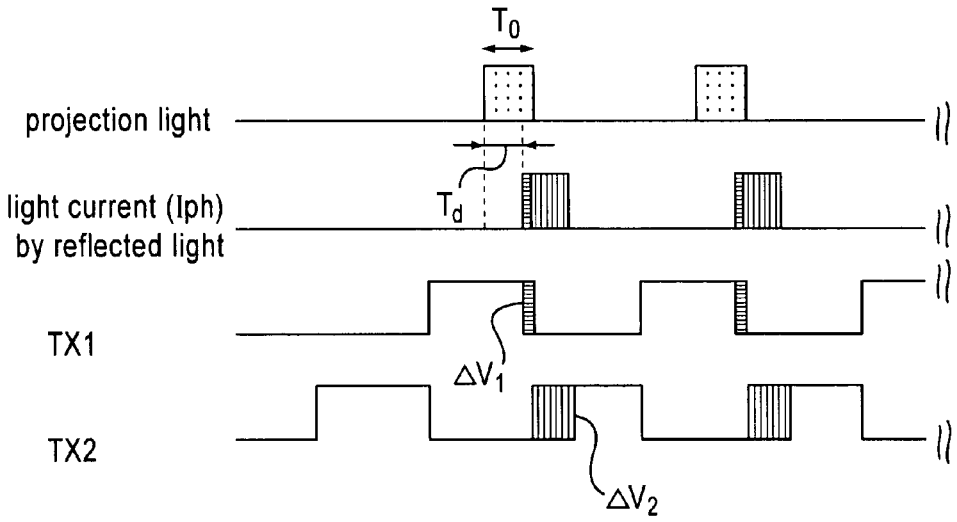
FIG. 4 is a timing chart of a signal at each essential part, for describing the principle of measuring a distance with a TOF method in FIG. 2.

Using the output terminal voltage V described above, the output terminal voltage ΔV1 and ΔV2 are derived as follows based on a timing chart of a pulse projection light and a signal electric charge transfer gate illustrated in FIG. 4. As illustrated in FIG. 4, T0 denotes a width of a lighting time of the pulse projection light, Iph denotes a light current that flows by the photoelectric conversion of the reflected light; c denotes the speed of light, C1 and C2 denote an output terminal capacity. The output terminal voltage V1 and V2 are determined according to the next [expression 1] (numerical formula 1).

(Numerical formula 1)

$$\Delta V1 = \frac{1}{C1} \cdot Iph \cdot (T_0 - T_d) \quad (1)$$

$$\Delta V2 = \frac{1}{C2} \cdot Iph \cdot T_d \quad (2)$$

In addition, as illustrated in FIG. 3, the terminal capacity C1 and C2 are C1=C2 because the structure of the two output terminals are identical. When this condition is substituted for the [expression 1] (numerical formula 1) to determine the distance L, the following [expression 2] (numerical formula 2) can be determined.

(Numerical formula 2)

$$L = \frac{1}{2} \cdot c \cdot \frac{\Delta V2}{(\Delta V1 + \Delta V2)} \cdot T_0 \quad (3)$$

As a result, the distance L among the plurality of points in a space can be measured.

Returning to the description of FIG. 1, the person location detecting control section 4, which is a characteristic configuration of the present embodiment, is configured with various control sections necessary for controlling the entire person location detecting apparatus 1. The person location detecting control section 4 includes: a timing control section 41 for controlling each driving timing of the power LED driver 21 and the TOF method distance image sensor 31; a host interface section 42 for communicating with the air conditioner 11 on the host side; a data formatter section 43 for converting an output data stream from the TOF method distance image sensor 31 into a predetermined format; a distance changing detection section 44 as a distance changing detection means for detecting a distance change in a room space from a distance frame of a room space determined based on distance information (output voltage information in accordance with distance) from the TOF method distance image sensor 31; and a person distinguishing section 45 as a person distinguishing means for distinguishing whether or not an object is a person by identifying a shape of the object in a detected distance change area. The person location detecting control section 4 detects a direction to the distance change area where the shape of the object is identified as a person (which is determined from X and Y coordinates of distance frame information), and a distance (which may be an average distance, a range of a distance aggregate, or a specific location, such as a specific location of a head), as a location of a person.

The timing control section 41 controls a timing to emit the plurality of power LED module 22 via the power LED driver 21, and controls an opening and closing timing of transfer gates TX1 and TX2 of each light receiving section of the pixel array section 311 reciprocally in such a manner to distribute a signal in accordance with the elapsing of time, as illustrated in FIG. 4.

The host interface section 42 is an interface for communicating to exchange necessary information with an application processor 11*a* of the air conditioner 11 as a controlling object. For example, when a person is detected in a room, the host interface section 42 communicates with the application processor 11*a* with location information of the person, which indicates "someone is in a room", with three dimensional coordinates of X, Y and Z. Based on the three dimensional coordinates of X, Y and Z of the location information of the person, a control position of each blade in the up-and-down direction and the left-and-right direction as well as a driving output (wind power) of a ventilator are controlled on the air conditioner 11 side. As a result, an air flow control is performed such that an air flow around a person, in particular, is effectively exchanged and air around the person is kept fresh in such a manner that the air flow does not directly hit the person.

The pixel array section 311 is configured with eighty thousand pixels, for example, as a plurality of light receiving sections. An output from a sensor is a parallel output with a two pixel unit for the purpose of fast processing, and output information for one pixel is outputted by ΔV1 and ΔV2 of output voltage of two terminals. Therefore, in the data format section 43, as a latter signal processing, data form is changed so as to facilitate the arithmetic processing.

The distance changing detection section 44 measures the distance L in a room space in real time by the expression 2 described above based on the distance information (which is output voltage information in accordance with the distance as well as information of the expression 1 described above) from the TOF method distance image sensor 31. Subsequently, the distance changing detection section 44 calculates a time change amount (differential value) of the distance of the room space based on the measured distance L (distance frame) and compares it with a predetermined threshold so as to detect an existence or non-existence of the distance change.

That is, the distance changing detection section 44 determines whether or not a person exists by determining whether or not there is a "change of distance". Information of 30 frames per second is sent from the distance image sensor 31 to the distance changing detection section 44, and the distance changing detection section 44 determines whether or not the distance is in a balanced state based on the frame information. Based on the sensor output frame information, the distance frame information is calculated by the [expression 2] described above. Based on this distance frame information, the changing amount (differential value) with respect to the time of the distance L. The differential value becomes asymptotic to "0" as the time elapses if there is no change of the distance L to the time. In order to establish a distance balanced state, a threshold value (distance frame difference threshold value) of the distance L with respect to the time change is set. When the differential value described above is below the set threshold value, the distance balanced state "without the time change of the distance" is defined, and the distance frame at that moment is defined to be a balanced range frame (BRF). A few of the threshold values (distance frame difference threshold value) of the distance L described above with respect to the time change are prepared in a table for each representative distance by more than the sensor distance resolution (distance that is rougher than the distance detected by the sensor) in view of the distance resolution performance of the sensor. The distance balanced state is established when the differential value described above continues to be below the set threshold value from several seconds to several tens of seconds.

More particularly, the distance changing detection section 44 includes: a distance balanced state determining section 44*a* for calculating the distance L (frame distance value) of the room space by the expression 2 described above based on the distance information (which is output voltage information in accordance with the distance as well as information of the expression 1 described above) from the TOF method distance image sensor 31, measuring in real time the time change amount (differential value of FIG. 5) of the distance L of the room space, and determining that the distance in the room is in a balanced state by the time change amount of the measured distance L being asymptotic to "0" when there is no change in the location of the object; and a distance change state determining section 44*b* for calculating a difference value between a frame distance value in a distance balanced state of a room space, which is recorded in advance in a predetermined recording section, and a frame distance value calculated by the expression 2 described above from the distance information (output voltage information in accordance with the distance) from the TOF method distance image sensor 31, and determining that "the distance is in a changing state" in the room, such as "someone has entered a room" and "the person in the room made a move", when the difference value is above the predetermined threshold value and continues for more than a set duration of time. In this case, a few of the distance frame difference threshold value (threshold value with respect to the time change of the distance L), which is set in view of the distance resolution performance of the TOF method distance image sensor 31, are prepared for each measure distance range and maintained in a table in order to improve the accuracy of the distance change determination.

Figure 5:
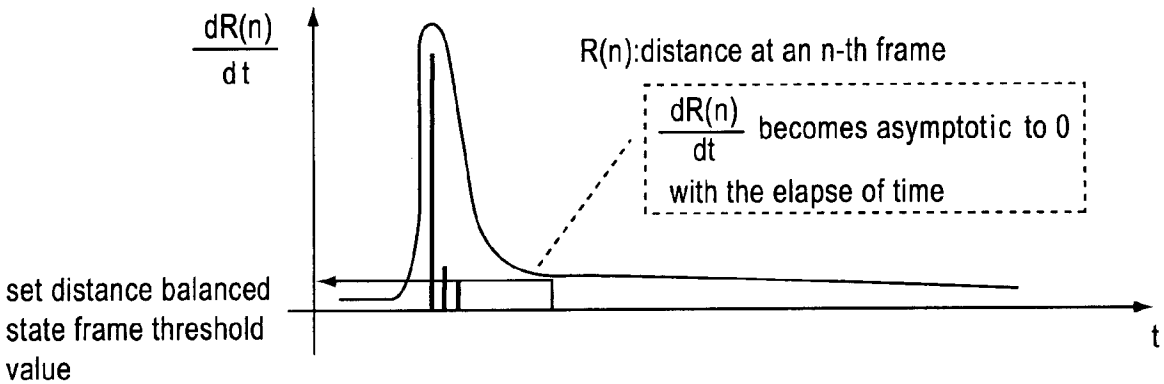
FIG. 5 is a diagram illustrating a time change amount of image information of a distance for determining a distance balanced state in a distance balanced state determining section in FIG. 1.

As illustrated in FIG. 5, the distance balanced state determining section 44*a* calculates the distance L (frame distance value) of the room space from distance information (which is output voltage information in accordance with the distance as well as information of the expression 1 described above) outputted from the TOF method distance image sensor 31 by the expression 2 described above, and calculates the changing amount (differential value) with respect to the time of the distance L, as illustrated in FIG. 5, based on the distance frame of the distance L. The differential value becomes asymptotic to "0" as time elapses if there is no change of the time with respect to the distance L. In order to establish a distance balanced state, a threshold value of the distance L with respect to the time change is set. When the differential value described above is below the set threshold value, the distance balanced state "without the time change of the distance" is defined, and the distance frame at that moment is defined to be a balanced range frame (BRF).

Figure 6:
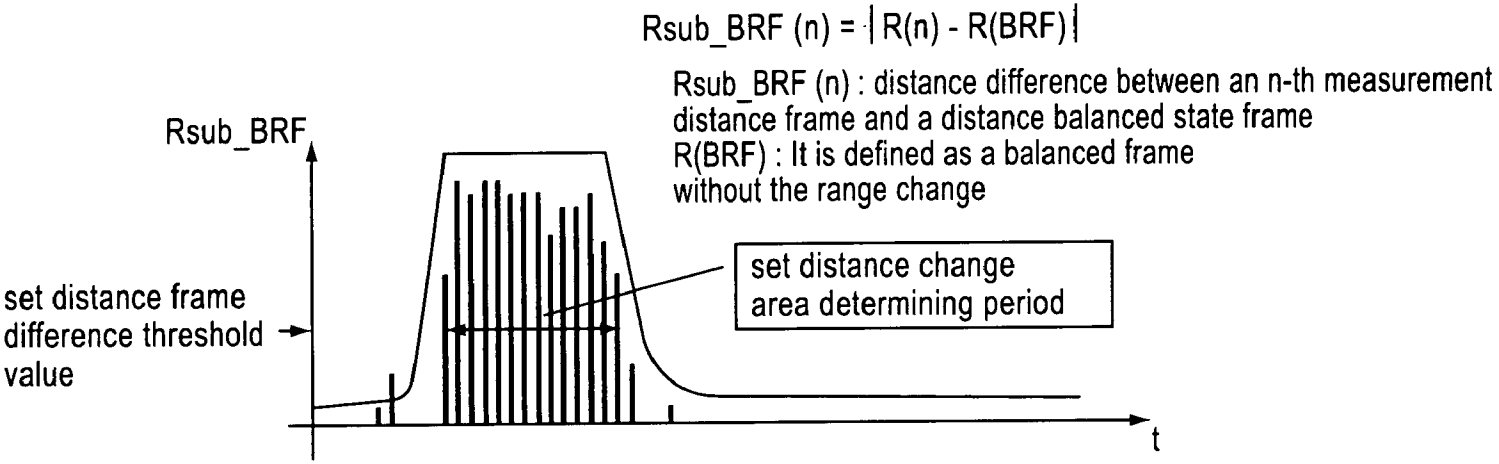
FIG. 6 is a diagram illustrating a BRF distance difference frame (Rsub BRF) with respect to a time for determining a distance change determining state in a distance change state determining section in FIG. 1.
Figure 7:
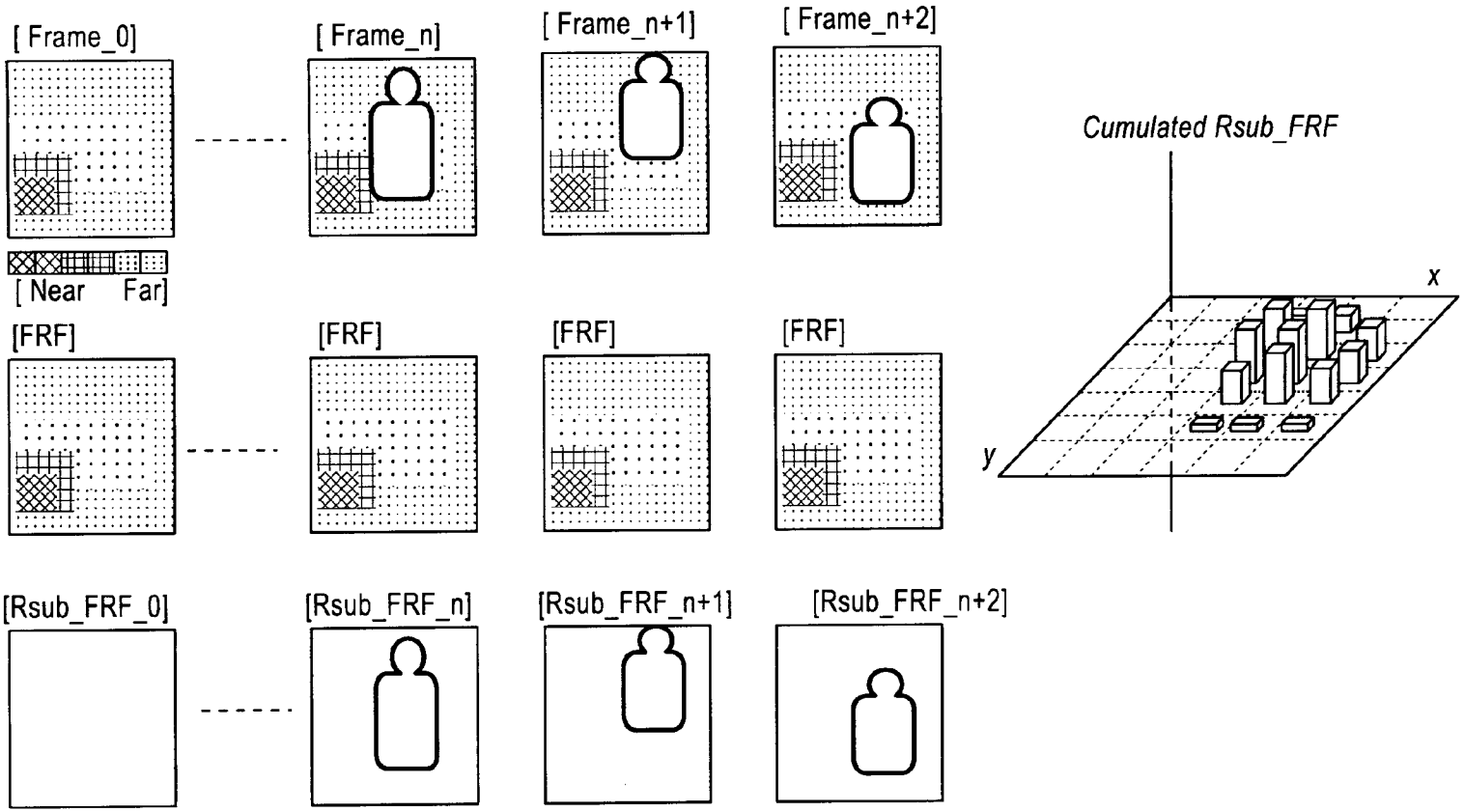
FIG. 7 is a series of four diagrams schematically illustrating a distance balanced state frame (BRF), input distance frame (Frame) and a BRF distance difference frame (Rsub-BRF), which is a distance difference of the BRF and the Frame, in the distance change state determining section in FIG. 1.
Figure 11:
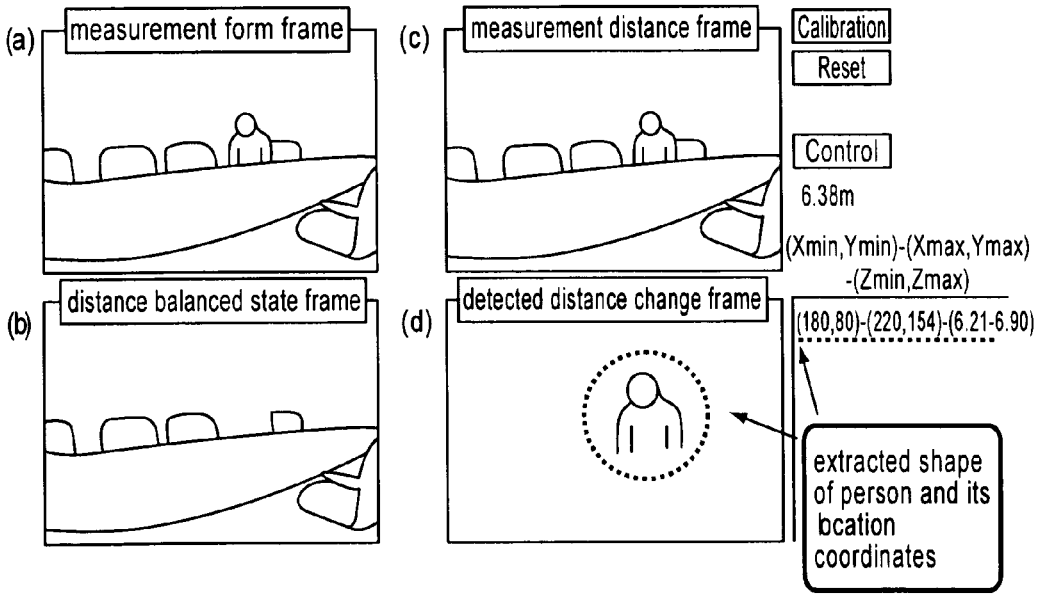
FIG. 11(*a*) is a diagram illustrating a measurement form frame.
Figure 12:
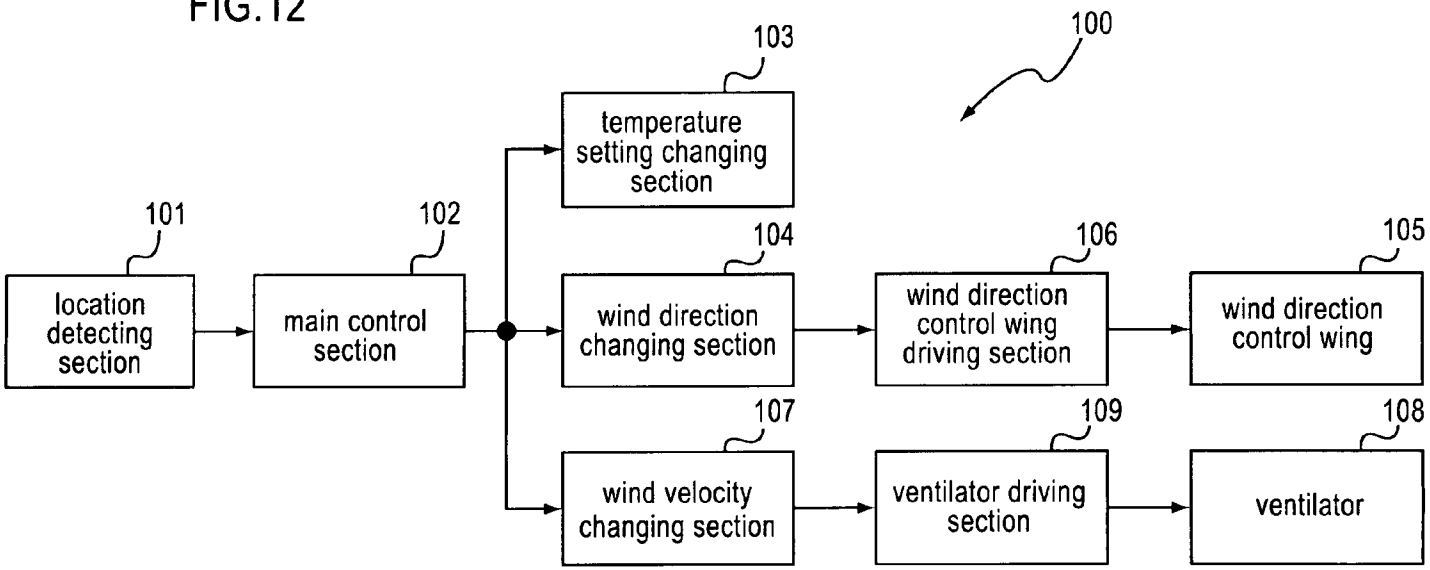
FIG. 12 is a block diagram illustrating an exemplary essential configuration of a conventional air conditioner disclosed in Reference 1.

In the distance change state determining section 44*b* as illustrated in FIG. 6, a distance difference between the distance balanced state frame (BRF) and the distance frame measured by the expression 2 described above from arbitrary distance information (which is output voltage information in accordance with the distance as well as information of the expression 1 described above) outputted from the TOF method distance image sensor 31, is defined to be a BRF distance difference frame (Rsub BRF). The BRF distance difference frame (Rsub BRF) is monitored. When the value is above the set distance frame difference threshold value as illustrated in FIG. 6 and the period is above the set distance change determining period (predetermined threshold value of the period), it is considered that there is a change in the distance change determining state and the distance L, and it is determined that the target object A has appeared in the room. FIG. 11(*a*) illustrates a measurement form frame. FIG. 11(*b*) illustrates a distance balanced state frame. FIG. 11(*c*) illustrates a measurement distance frame. FIG. 11(*d*) illustrates a detected distance change frame.

Figure 9:
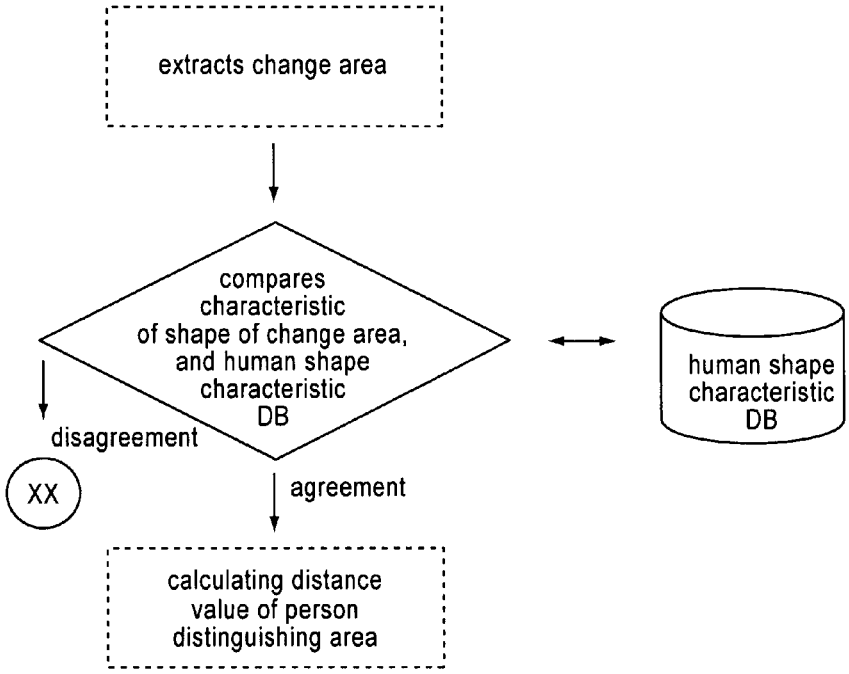
FIG. 9 is a flow chart illustrating an operation of a person distinguishing section in FIG. 1.

The person distinguishing section 45 determines whether or not the target object A is a person. As illustrated in FIG. 8, the person distinguishing section 45 compares a value indicating a characteristic of a registered shape of a person with regard to a moving state and a still state of a person, such as a standing state, a sitting state, a lying state, and a figure difference (adult and child, man and woman) as a person comparing data that is stored in advance in a human shape characteristic data base (human shape characteristic DB), and a value indicating a characteristic of a shape of the distance change area (when it is a person, it has a shape of a human) extracted from the distance change area that is determined that there is a distance change as illustrated in FIG. 9, to distinguish whether or not the target object A is a person.

The person distinguishing section 45 divides the value indicating a characteristic of a shape of a person that is registered in the human shape characteristic DB into a head, a trunk (a body), a leg, and an arm of a human body. Next, the person distinguishing section 45 calculates, for example, a ratio of the trunk width (short side length) and the head width (short side length) and/or a ratio of the trunk length (long side length) and the head length (long side length) based on the short side length (width) and long side length (length) of each of the body parts and standardize the ratio to distinguish whether or not the target object A is a person. A maximum value, a minimum value, an average value, and a standard deviation value are calculated from the registered value indicating a characteristic of a shape of a person. A range of an indication value of a shape characteristic pattern is determined from the maximum and minimum values. A degree of variation of the shape characteristic pattern is determined from the standard deviation value. A person is distinguished by whether or not the value is within the range of an indication value of a shape characteristic pattern.

Figure 10:
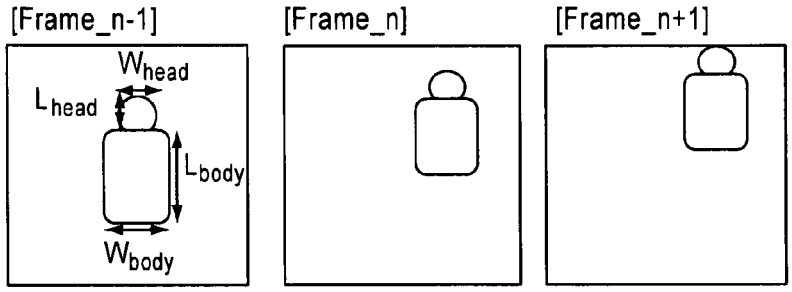
FIG. 10 is a diagram illustrating a value indicating a characteristic of a shape in a person distinguishing section in FIG. 1.

That is, the portion where there is a distance change is determined as a person by distinguishing whether or not the portion is a person using the characteristic of the shape. As illustrated in FIG. 9, the shape of where there is a distance change is first extracted. A flattened shape of a three dimensional shape formed by a plurality of points that correspond to respective distances, is recognized. Next, the shape is distinguished using an indicator. "Whether or not it is a person" is distinguished by comparing a value indicating the shape of the extracted changed area and a value indicating human shape characteristic information of the human shape characteristic information data base (human shape characteristic information DB). For example, as illustrated in FIG. 10, a ratio Wh/Wb of the width of the head and trunk and/or a ratio Lh/Lb of the length of the head and trunk are determined. The ratio is normalized within a value range that is easy for the determination process. The "adult" and "child" and the "man" and "woman" respectively have a different ratio.

Lastly, the direction (which is determined from the X and Y coordinates of the distance frame information) and distance (which may be an average distance, a range of an distance aggregate, or a specific location, such as a specific location of a head) of the distance change area that is specified as a shape of a person are detected as a location of the person.

According to the embodiment as described above, signal charges, which are distributed depending on the flight time of light (delay time) corresponding to the distance L to the object, are outputted from two of the image output electrodes V1 and V2, and the signal charges are converted into the output voltage information that corresponds to the distance and are outputted from the TOF method distance image sensor 31 as distance information. Included are a distance change detecting section 44 for detecting, based on the distance information from the TOF method distance image sensor 31, the flight time T of light and determining the distance L to the object by $L=(1/2)\cdot c\cdot T$, where c is the known speed of the light, and based on this, detecting the distance change to the object in the room space; and a person distinguishing section 45 for distinguishing a person by specifying the shape of the detected distance change area. Because the direction and the distance of the distance change area that is identified as a shape of a person as a location of the person, the amount of the calculations will not be enormous as in the conventional triangulation even when the arithmetic processing is performed on all of the plurality of points in a two-dimensional way. As a result, the location (direction and distance) of the person can be detected with high accuracy in a room. With the highly accurate detection of the location of the person, the temperature, humidity, and the air flow can be accurately controlled in the room in accordance with the location of the person, thereby improving the conservation of energy and the comfort.

In the embodiment, a case has been described where the person location detecting apparatus according to the present invention is used for the control of the air conditioning of the air conditioner 11 for conditioning and controlling the temperature, humidity and air flow of the room in accordance with the location of the person. However, without the limitation to this, any electronic device can be used as long as the electronic device can use the person location information from the person location detecting apparatus 1 for detecting the person location information (direction and distance) to an object in a room in an accurate and three dimensional way so as to control the temperature, humidity and air flow of the room.

As described above, the present invention is exemplified by the use of its preferred embodiment. However, the present invention should not be interpreted solely based on the embodiment described above. It is understood that the scope of the present invention should be interpreted solely based on the claims. It is also understood that those skilled in the art can implement equivalent scope of technology, based on the description of the present invention and common knowledge from the description of the detailed preferred embodiment of the present invention. Furthermore, it is understood that any patent, any patent application and any references cited in the present specification should be incorporated by reference in the present specification in the same manner as the contents are specifically described therein.

INDUSTRIAL APPLICABILITY

The present invention can be applied in the field of a person location detecting apparatus for detecting a location of a person and an air conditioner using the person location detecting apparatus, for detecting a location of a person to perform various kinds of controls to make a person comfortable, such as air conditioning control for preventing air flow to directly hit a person. According to the present invention as described above, included are a distance change detecting section for detecting the change of distance to an object in a space of a room based on distance information (information regarding output voltage in accordance with the distance) from a TOF method distance image sensor; and a person distinguishing section for distinguishing whether or not the object is a person by identifying a shape of the object in the detected distance change area; and a direction and distance to the distance change area, where the shape of a person is identified and detected as a location of a person. Because of this, the amount of calculation will not be enormous as in the conventional triangulation even when arithmetic processing is performed on all of the plurality of points in a two dimensional way, and a location (direction and distance) of a person can be detected with high accuracy in a room. Therefore, the temperature, humidity and air flow can be accurately controlled in accordance with the location of a person, thereby improving the conservation of energy and the comfort.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A person location detecting apparatus comprising:

a projection light;

a light emitting section for radiating the projection light;

a TOF (Time Of Flight) method distance image sensor for receiving a reflected light from a room space of the projection light to output distance information in accordance with a distance to an object in the room space from each of a plurality of light receiving sections;

a distance change detecting section for detecting a distance change to the object in the room space based on the distance information from the TOF method distance image sensor; and a person distinguishing section for distinguishing a person by identifying a shape of a detected distance change area to detect a direction and distance to the distance change area that is identified as a shape of a person as a location of a person, wherein the distance change detecting section measures a distance to the object in the room space in real time using the TOF method distance image sensor, calculates a differential value of the measured distance with respect to time, and determines that the measured distance is in a balanced state when the differential value becomes asymptotic to zero.

2. A person location detecting apparatus according to claim 1, wherein the determining that the measured distance is in a balanced state corresponds to a case where there is no change in the location of the object.

3. A person location detecting apparatus according to claim 1, wherein the distance change detecting section includes a distance change state determining section for calculating a distance difference value of a frame distance value of the room space in a distance balanced state and each frame distance value from the TOF method distance image sensor to determine that the distance in the room space is in a changing state when the distance difference value is greater than or equal to a predetermined threshold value and continues for a set time or more.

4. A person location detecting apparatus according to claim 3, wherein the distance difference value sets a distance frame difference threshold value for each measurement distance range in accordance with a distance resolution of the TOF method distance image sensor, and maintains the distance frame difference threshold value in a predetermined recording section in a table.

5. A person location detecting apparatus according to claim 1, wherein the person distinguishing section distinguishes a person by comparing a value indicating a characteristic of a registered shape of a person with regard to a moving state and a still state of a person, and a figure difference and a value indicating a characteristic of a shape of the detected distance change area.

6. A person location detecting apparatus according to claim 5, wherein the value indicating the characteristic of the registered shape of the person is normalized by dividing a human body into each part of a trunk, a leg, and an arm and calculating a ratio of a short side length and a long side length in each part of the human body.

7. A person location detecting apparatus according to claim 6, wherein the value indicating the characteristic of the registered shape of the person is determined by calculating at least a maximum value and a minimum value and determining an indicated value range of a shape characteristic pattern from the maximum value and the minimum value.

8. A person location detecting apparatus according to claim 6, wherein the value indicating the characteristic of the registered shape of the person is determined by calculating at least a maximum value, a minimum value and an average value as well as calculating a standard deviation value using the average value, determining an indicated value range of a shape characteristic pattern from the maximum value and the minimum value, and determining a degree of variation of a shape characteristic pattern from the standard deviation value.

9. A person location detecting apparatus according to claim 1, wherein the light emitting section radiates a near infrared pulse light at a constant cycle as the projection light to the room space.

10. A person location detecting apparatus according to claim 1, wherein the light receiving section includes a photoelectric conversion section in a middle, and two pixel output electrodes V1 and V2 at points with point symmetry with respect to a center of the photoelectric conversion section interposed therebetween with two electric charge transfer gates for inputting gate signals that are contrary to each other, and outputs from the two pixel output electrodes V1 and V2 signal charges divided depending on a flight time of light corresponding to a distance to the object as the distance information.

11. A person location detecting apparatus according to claim 10, wherein the signal charges from the two pixel output electrodes V1 and V2 are converted into output voltage information in accordance with the distance and outputted from the TOF method distance image sensor as the distance information.

12. A person location detecting apparatus according to claim 1, wherein the distance L to the distance change area, the shape of which is identified as the person, is estimated by detecting the flight time T of the light to the person, and by letting c be a known speed of the light from $L=(1/2)cT$.

13. An air conditioner for detecting a location (direction and distance) of a person using the person location detecting apparatus according to claim 1, and for performing an air conditioning in accordance with the detected location of the person.

* * * * *